US005690380A

United States Patent [19]

Waters

[11] Patent Number: 5,690,380

[45] Date of Patent: Nov. 25, 1997

[54] SLIPCOVERS WITH INTERCHANGEABLE TRIM

[76] Inventor: Abby Waters, 21346 St. Andrews Blvd. #209, Boca Raton, Fla. 33433

[21] Appl. No.: 700,924

[22] Filed: Aug. 23, 1996

[51] Int. Cl.[6] ..... A47C 27/00

[52] U.S. Cl. ..... 297/225; 297/228.11; 297/223; 297/219.1

[58] Field of Search ..... 297/218.4, 219.1, 297/223, 225, 228.1, 228.11, 228.12, 228.13, 229, 188.06

[56] References Cited

U.S. PATENT DOCUMENTS

| | | | |
|---|---|---|---|
| D. 276,103 | 10/1984 | Turner et al. . | |
| D. 280,481 | 9/1985 | Kornegay . | |
| D. 303,473 | 9/1989 | Sheinman . | |
| D. 307,995 | 5/1990 | Kelldorf . | |
| D. 331,346 | 12/1992 | Gayden . | |
| 1,304,753 | 5/1919 | Dwyer | 297/228.11 X |
| 2,522,404 | 9/1950 | Siebelist . | |
| 3,109,474 | 11/1963 | Levi | 297/223 X |
| 3,371,957 | 3/1968 | Cook | 297/225 |
| 3,479,085 | 11/1969 | Weinstein | 297/228.1 |
| 4,475,768 | 10/1984 | Webb . | |
| 4,718,721 | 1/1988 | Pompa . | |
| 5,112,104 | 5/1992 | De Giacomi | 297/229 |
| 5,540,480 | 7/1996 | Christa | 297/219.1 |

FOREIGN PATENT DOCUMENTS

| | | | |
|---|---|---|---|
| 1333241 | 6/1993 | France | 297/223 |
| 521124 | 5/1940 | United Kingdom . | |
| 944187 | 12/1963 | United Kingdom . | |
| 1316564 | 5/1973 | United Kingdom | 297/228.11 |
| 2012160 | 7/1979 | United Kingdom . | |

*Primary Examiner*—Laurie K. Cranmer
*Attorney, Agent, or Firm*—Richard C. Litman

[57] ABSTRACT

Slipcovers are provided for light, portable folding or non-folding chairs, and include interchangeable trim components which may be removably secured to the backs and/or other areas of the slipcovers to suit the specific occasion. The slipcovers themselves may be formed of two facing sheets of material, with each sheet having a different appearance to provide for the reversibility of the covers for further versatility. Different attachments may be used to secure the trim components removably to the slipcovers, and to secure the slipcovers to the chairs, such as a pocket or strap(s) located at the forward portion of the chair seat bottom, beneath the outer portion of a non-reversible cover. This pocket or strap(s) may be secured around the forward portion of the seat bottom of a folding chair. Other ties, straps, and fasteners may be provided as required. Padding or upholstery may be provided in the seat bottom and/or seat back areas, as desired, for additional comfort. The present slipcovers provide an excellent way of decorating the seating.

17 Claims, 4 Drawing Sheets

SLIPCOVERS WITH INTERCHANGEABLE TRIM

BACKGROUND OF THE INVENTION

1. Field of the Invention

The present invention relates generally to temporary covers for folding and non-folding chairs and related furnishings, and more specifically to chair slipcovers with interchangeable trim articles. The interchangeable trim allows for numerous variations in style using a single cover. One cover could provide many different looks just by changing the trim. The slipcovers themselves may also be reversible to provide further variation.

2. Description of the Prior Art

In the past, slipcovers have been of a fixed appearance and configuration. Slipcovers have been used to cover unattractive furniture or to provide protection for furniture. Slipcovers have been used to change the color or style of a piece of furniture, but only by completely removing and changing the cover. The covers revealed in a search of U.S. and foreign references have found no slipcovers that have detachable and interchangeable articles. Accordingly, a need is seen for slipcovers for use with folding and non-folding chairs that would provide a variety of appearances for various gatherings, occasions, and general home decoration. The present slipcovers may be provided in various embodiments providing for attachment to different types of chairs and may be reversible to double their versatility. A discussion of the prior art known to the inventor, and its differences from the present invention, is provided below.

U.S. Pat. No. 2,522,404 issued on Sep. 12, 1950 to Rudolf Siebelist describes a Slip Covering For Armchairs, adapted for use with chairs having an open arm configuration. Accordingly, various openings, passages, cutouts, and the like are provided in the slipcover in order to allow it to pass around the points of connection of the arms to the rest of the chair structure. No mention is made of any detachable or interchangeable trim, nor of any reversibility, in the Siebelist patent.

U.S. Pat. No. 4,475,768 issued on Oct. 9, 1984 to Ronald C. Webb describes a Seat Member With Exchangeable Cover, directed to removably replaceable seat covers (but not seat back covers) for pedestal type seating (pivotally mounted stools, etc.). Webb requires some form of attachment means (Velcro—tm, etc.) to be secured to the underside of the seat bottom, so his cover may be secured thereto. No such attachment means is required to be placed on chairs using the present slipcovers. Webb is silent regarding any interchangeable trim or reversibility.

U.S. Pat. No. 4,718,721 issued to Susan Pompa on Jan. 12, 1988 describes a Chair Cover adapted for use with motorized carts and wheelchairs for invalids. The cover includes a thicker central area for securing between the bottom and back cushions of the seat, which would not be adaptable to many portable chairs molded monolithically as a single unit. Pompa states that her cover is reversible, but by this she means from seat back to seat bottom, and not by means of opposite faces of material, as in the present slipcover. Pompa makes no mention of interchangeable trim.

U.S. Pat. No. D-276,103 issued on Oct. 30, 1984 to William F. Turner et al. illustrates a design for a Chair Cover, apparently formed as a series of semicylindrical elements. No attachment to the underlying chair is disclosed, nor is any reversibility or interchangeable trim disclosed by Turner et al.

U.S. Pat. No. D-280,481 issued on Sep. 10, 1985 to Cecil E. Kornegay illustrates a design for a Slipcover for an armchair. The cover includes a gathered skirt portion extending downwardly from the vertical surfaces below the arms and from below the front cushion, but no interchangeable trim is provided. Also, no reversibility is disclosed, nor is any means of attaching the cover to a chair, particularly an armless portable chair, disclosed.

U.S. Pat. No. D-303,473 issued on Sep. 19, 1989 to Andrew Sheinman illustrates a Chair Cover adapted for use with a conventional armless folding chair. The cover includes a generally horizontal bow disposed across the back thereof. However, no reversibility nor interchangeable trim is disclosed, as provided by the present slip covers.

U.S. Pat. No. D-307,995 issued on May 22, 1990 to Mitchell T. Kelldorf illustrates a Chair Cover apparently adapted for use with folding chairs. The cover is apparently intended to protect the chair, rather than for any decorative function, as the fit as illustrated does not apparently allow for seating while the cover is installed on the chair. In any event, no attachment means, reversibility, or interchangeable trim is disclosed by Kelldorf.

U.S. Pat. No. D-331,346 issued on Dec. 1, 1992 to Anthony W. Gayden illustrates a Furniture Cover for various configurations of armchairs capable of seating one or two persons. No disclosure is made of any interchangeable trim, means of securing the cover to the chair, use with an armless chair, or reversibility, all of which are provided by the present slipcover.

British Patent Publication No. 521,124 to John Barker & Co., Ltd. et al. and accepted on May 13, 1940 describes Improvements In Or Relating To Furniture Covers, comprising an armchair cover having a short skirt at the base thereof which is adjustable in length at the back, to provide a fit for different chairs. No means of securing the cover to the chair (except for the skirt adjustment), reversibility, or interchangeable trim is disclosed.

British Patent Publication No. 944,187 to Frederick G. Hobden and published on Dec. 11, 1963 describes Improvements In Protective Covers For Furniture, adapted for use with armchairs. The cover is incomplete, and does not cover the sides and back of the chair. No reversibility, attachment means, or interchangeable trim is disclosed by Hobden.

Finally, British Patent Publication No. 2,012,160 to Lucchino O. Visconti and published on Jul. 25, 1979 describes a Removable Furniture Covering, adapted for application to a folding deck chair or the like. Large, upholstered arms and upper back are disclosed, which preclude reversibility. No interchangeable trim is disclosed.

None of the above inventions and patents, either singly or in combination, is seen to describe the instant invention as claimed.

SUMMARY OF THE INVENTION

Accordingly, it is a principal object of the invention to provide improved slipcovers for folding or non-folding temporary seating, which slipcovers include interchangeable trim means providing for various appearances.

It is another object of the invention to provide improved slipcovers which are constructed of two different fabric sheets, and which are reversible in order to place one or the other of the sheets exteriorly of the seating upon which the cover is placed.

It is a further object of the invention to provide improved slipcovers which may include anchoring or attachment means to either folding or non-folding chairs, with the attachment means for folding chairs comprising at least an underlying retaining means disposed about the front portion of the forwardly extending chair seat.

An additional object of the invention is to provide improved slipcovers which interchangeable trim may comprise trim components removably attachable to the seat back and/or seat periphery areas of the cover, or other areas as desired.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
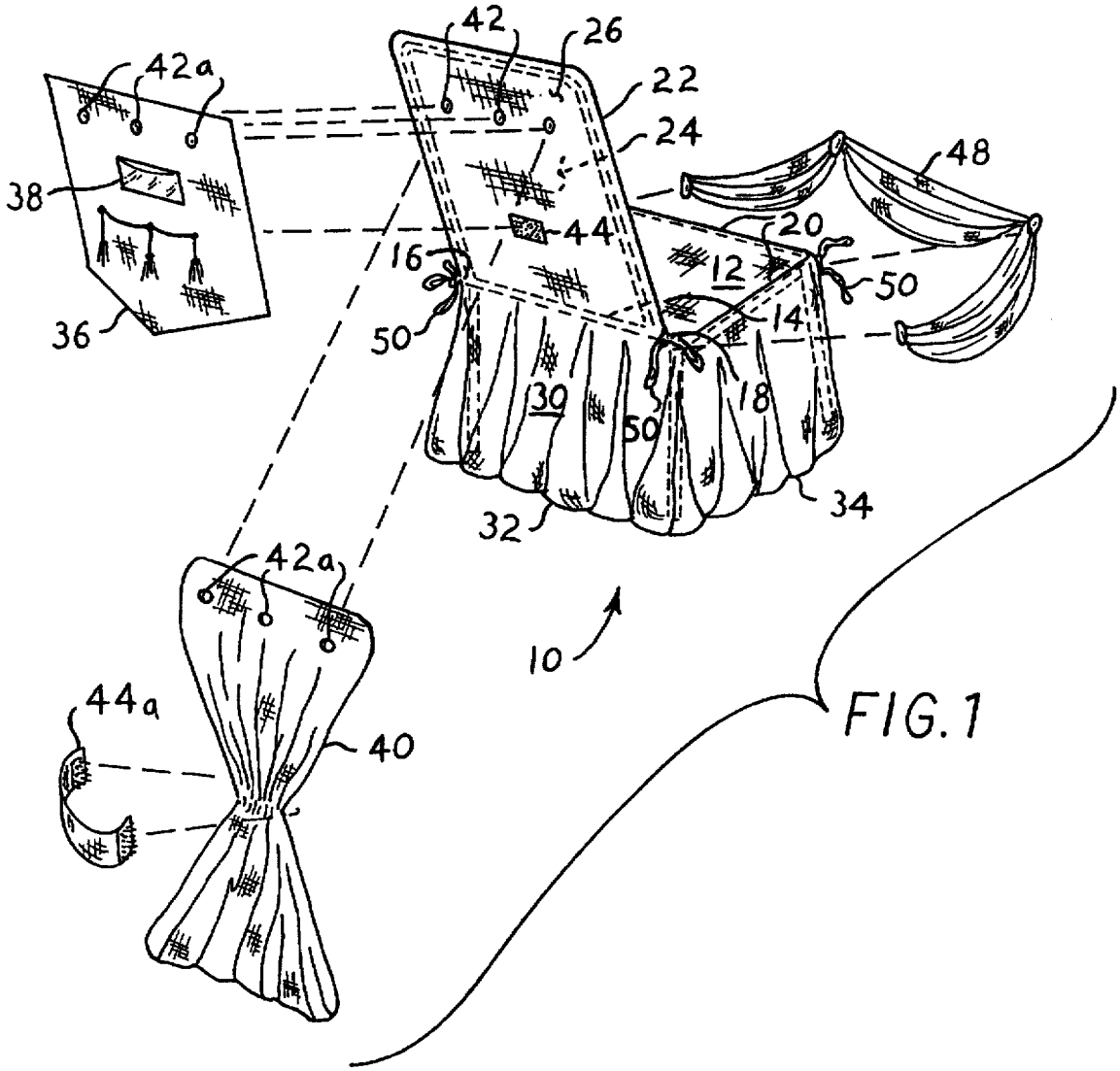
FIG. 1 is an exploded perspective view of a slipcover of the present invention, showing various interchangeable trim components removably attachable thereto.

The present invention comprises removable slipcovers, as in the slipcover 10 of FIG. 1, which covers are particularly well adapted for temporary use in providing decorative cover for temporary seating, as is generally provided by conventional folding or non-folding, stackable chairs or the like. Accordingly, the present removable slipcovers may be removably installed over such seating, and may be provided in a variety of different styles and configurations according to the type or theme of the gathering.

The slipcover 10 of FIG. 1 comprises a seat cover portion 12 adapted for positioning over the generally horizontal seat portion of the underlying chair, with the seat cover portion 12 having a rear edge 14 (more clearly shown in FIG. 2) with a first end 16 and an opposite second end 18. The seat cover portion 12 further includes a skirt attachment edge 20, which extends around the front of the seat cover portion 20 from the first end 16 to the opposite second end 18 of the rear edge 14. A chair back cover portion, generally designated as 22, comprises a front panel 24 and an opposite rear panel 26, which panels 24 and 26 are secured together along their lateral and upper edges, to define a seat back pocket 28 therebetween, more clearly shown in FIG. 2.

Figure 2:
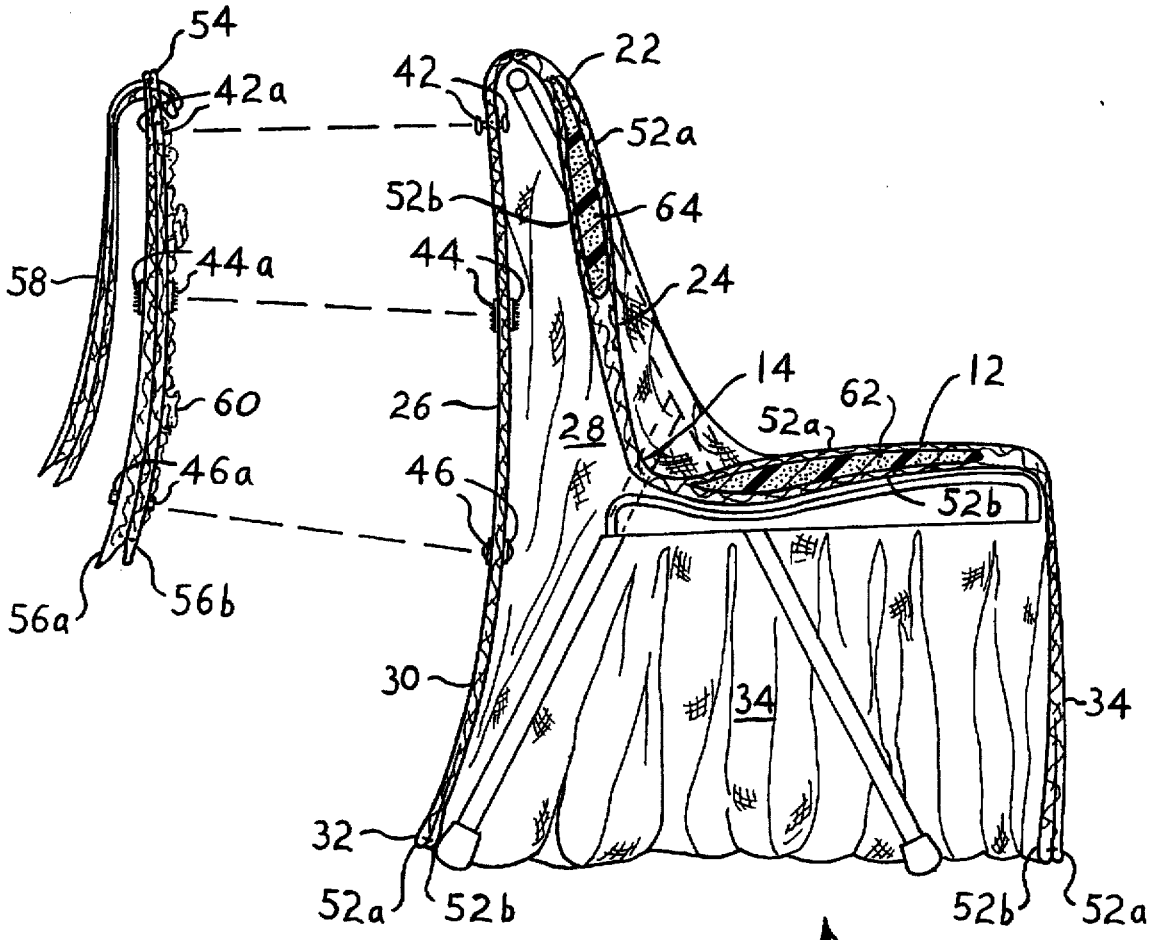
FIG. 2 is a side elevation view in section of a folding chair with a slipcover of the present invention removably installed thereover, showing various attachment means for the interchangeable trim.

The front panel 24 of the chair back cover 22 has a lower edge joined to the seat cover portion 12 at the rear edge 14 thereof and contiguous therewith, by stitching, etc., or the seat cover portion 12 and at least the front panel 24 of the chair back cover 22 may be formed as a single, continuous length of material, if desired. The rear panel 26 of the chair back cover 22 extends downwardly considerably farther than the seat cover 12, having a lowermost or rear skirt portion 30 terminating in a lower edge 32 which is approximately even with the lowermost ends of the chair legs, as seen in FIG. 2. The rear panel 26 and its lowermost portion 30 may be formed as a single, continuous sheet of material, if desired.

The skirt attachment edge 20 of the seat cover portion 12 has a skirt 34 depending therefrom, and extending around the front and sides of the seat cover 12 from the first end 16 to the second end 18 of the rear edge 14 of the seat cover 12. This skirt 34 is preferably stitched or otherwise secured to the rear skirt portion 30 extending from the rear panel 26 of the chair back cover 22, to form a continuous skirt completely around the entire lower portion of the underlying and supporting chair. While other constructions may be used to form the present slipcover 10, the above described construction requires a minimal number of pieces and seams, and provides a skirt 34 which may be decoratively embellished (ruffles, pleats, etc.) extending about the front and two sides of the cover 10 and its underlying and supporting chair.

As noted further above, the present slipcover 10 is well adapted for use as a temporary cover, and different decor is appropriate for each. Accordingly, a variety of different removably attachable chair back trim accessories may be provided, as shown in FIGS. 1 and 2. For occasions where seats have been preassigned, a trim accessory 36 having a placecard holder 38 or the like therein, may be used. Other seating identification means, such as removably applied monograms, or perhaps permanently applied monograms identifying the event, etc., may be used as desired. The trim accessory 40 of FIG. 1 provides a more stylish alternative, having a spread upper and lower end and a gathered center area. It will be seen that a multitude of different back panel trim accessories, and trim which is removably or permanently affixed to such accessories, may be provided, such as embroidery, jeweled ornamentation, floral arrangements, etc., as desired.

Each of the above trim accessories 36/40 is removably secured to the rear panel 26 of the chair back cover 22, by some form of mating temporary fastener means, such as buttons 42, hook and loop fastener material 44 (e.g., Velcro, tm), and/or snaps 46. One or more of these fastening means may be applied to the rear panel 26, with mating fastening means 42*a*, 44*a*, and/or 46*a* being applied to the facing surfaces of the trim accessories 36/40, as desired. The fastening means may be used to gather or otherwise shape the trim accessories as desired, as with the gathered trim 40 of FIG. 1.

Additional trim may be provided for the present slipcover 10, by means of removably attachable bunting or other skirt attachment 48, which may be applied along the skirt attachment edge 20 of the seat cover portion 12. Attachment means 42/44/46 may be used to provide for the removable attachment of the skirt attachment 48, or other means, such as the ties 50 shown in FIG. 1, may be used as desired. The skirt attachment 48 may be extended across the rear panel 26 of the chair back cover 22 to completely surround the slipcover 10, if desired, or may terminate at the first and second ends 16 and 18 of the seat cover rear edge 14 to surround the seat cover portion 12 on three sides, as desired.

While the above described interchangeable trim accessories provide great versatility for the present slipcover 10 to adapt it for various different occasions, further versatility may be achieved by making the slipcover 10 reversible, if desired. The slipcover of FIG. 2 will be seen to be formed of two different sheets of material, with a first or outer sheet 52*a* and a second or inner sheet 52*b*. This is most clearly seen adjacent one of the lower edges or seams of the cover 10, where the two sheets are secured together by means of a hidden seam therebetween. By forming the cover 10 using two opposed sheets 52*a* and 52*b* having different patterns or styles thereon, e.g., floral pattern for garden parties, etc., and perhaps balloons or another suitable pattern for birthdays, the cover 10 need only be turned inside out to place the first sheet to the inside and the second sheet to the outside, to provide a completely different appearance, as desired.

In a similar manner, the trim accessories may also be made to be reversible, by forming them of two different sheets of material if so desired. The chair back trim accessory 54 of FIG. 2 illustrates this, with a first sheet 56*a* including a decorative ribbon motif 58 thereover, while the opposite second sheet 56*b* is covered in a floral pattern 60, or other raised pattern, as desired. Other patterns may be provided as desired, from different materials to different prints of the same material, etc. It will be noted that the fastening means 42*a*, 44*a*, and 46*a* described further above for securing the chair back trim accessories to the rear panel 26 of the chair back cover 22, are provided on both sheets or surfaces 56*a* and 56*b* of the reversible trim accessory 54.

FIG. 2 also illustrates another advantage of the double sheet material providing for reversibility of the present slipcover 10, in that additional material may be secured between the two reversible sheets 52*a* and 52*b*, if desired. In FIG. 2, a seat cushion or padding 62 is shown between the two seat cover portion 12 sheets 52*a* and 52*b*, with a second back cushion or padding 64 shown between the two sheets 52*a* and 52*b* of the front panel 24 of the chair back cover portion 22. It will be noted that either, or both, of the above cushions or pads 62 and/or 64 may be installed within such a reversible cover 10, or secured to the underside of a single sheet of material for a non-reversible cover, if desired. However, the seat cushion 62 would be most appreciated when such covers 10 are used over a conventional metal folding chair having a stamped metal seat pan, as shown in FIG. 2.

Figure 3:
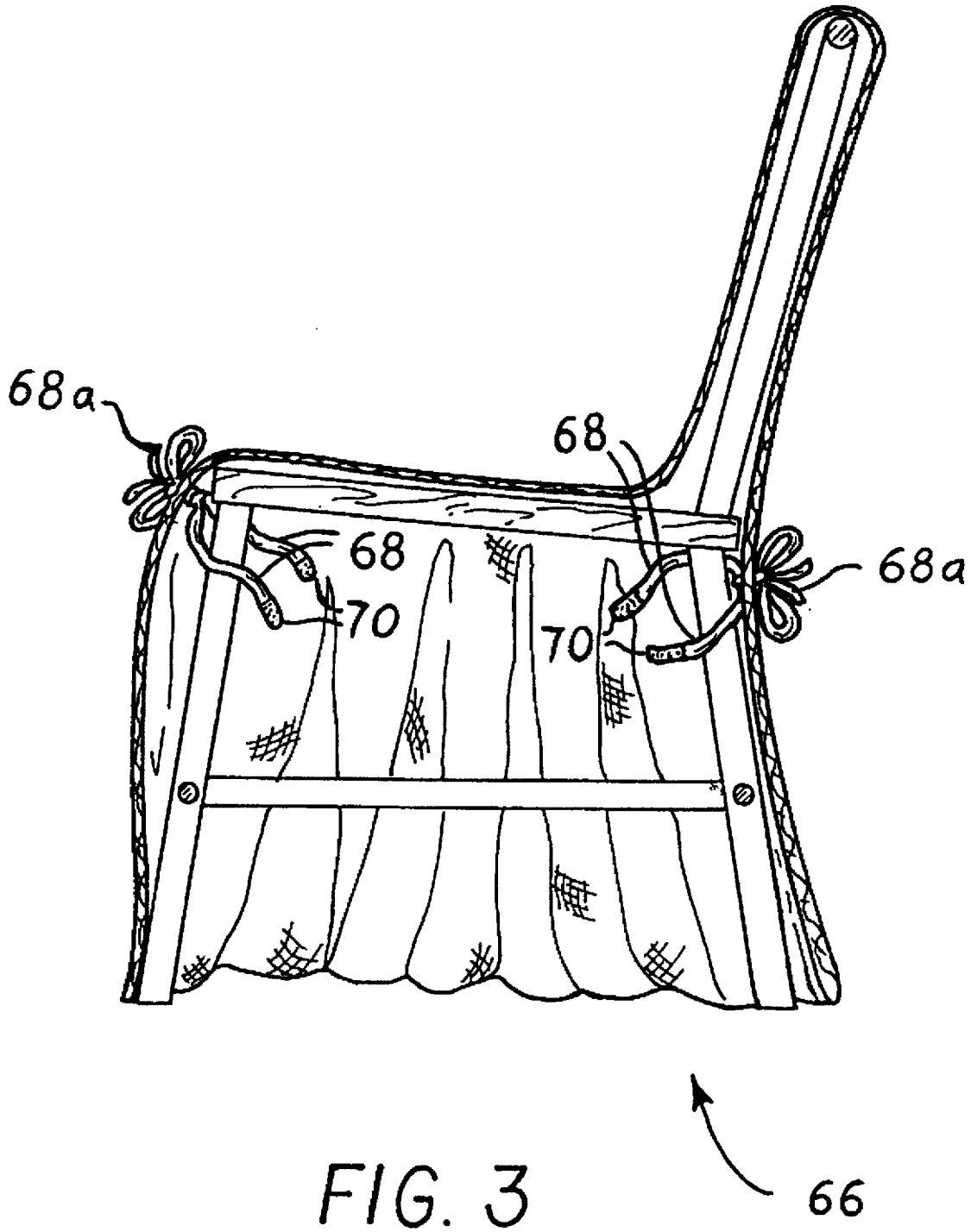
FIG. 3 is a side elevation view in section of a non-folding chair with a slipcover of the present invention removably secured thereto.

In addition to the above features of the present invention, some means of temporarily anchoring the slipcover to the underlying chair would be of benefit, particularly in outdoor settings where wind may cause movement of the covers. Even in indoor environments, persons brushing by the covered chairs while finding their seats could cause the covers to become dislodged or misadjusted. FIG. 3 discloses one means of anchoring or securing a cover 66 to a chair, in this case a non-folding chair, but the elongate ties or straps 68 located to the side of the cover 66 opposite the exposed periphery 68 of the seat cover portion 70 thereof. These straps 68 may include some form of mating attachment means on the ends thereof, such as the hook and loop fastening material 70 shown, or snaps, buckles, buttons, etc, as desired, or may comprise ties which may be tied together about the upper ends of the chair legs.

Such ties or straps 68 may also be provided on a reversible cover, if desired, by providing opposite ties/straps 68*a* at the corresponding points on the opposite surface of the cover 66, as shown. These externally disposed straps/ties 68*a* may be looped or tied together to form a decorative bow, as shown, or may be used to secure other articles (e.g., the skirt attachment 48 of FIG. 1) to the cover 66, as desired. If the cover 66 is made to be reversible, then the ties 68*a* may be loosened and used to secure the reversed cover 66 to the chair, with the now outwardly facing ties 68 being formed as decorative bows or used to attach other articles to the cover 66.

While nonfolding chairs, such as the chair shown in section in FIG. 3, are conventionally equipped with four legs extending from each of the corners of a generally quadrilateral seat, folding chairs, such as the chair shown in section in FIG. 2, are configured differently. Such folding chairs conventionally have their seats cantilevered forwardly from the folding mechanism near the rear edge of the seat, with no support being provided directly beneath the forward portion of the seat. Thus, there is typically no place provided to secure a tie or strap to the forward portion of the seat on such folding chairs.

Figure 4:
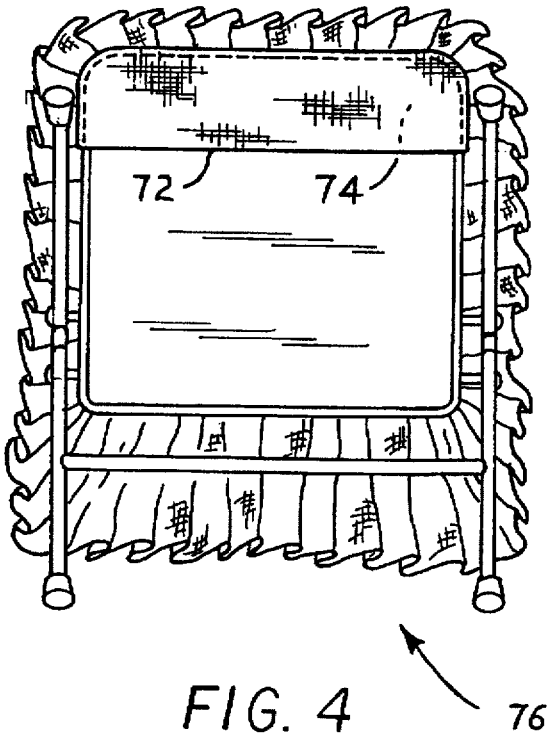
FIG. 4 is a bottom plan view of a slipcover of the present invention disposed over a folding chair, and showing a forward pocket enclosing the forward edge of the seat bottom of the chair to secure the cover thereover.
Figure 5:
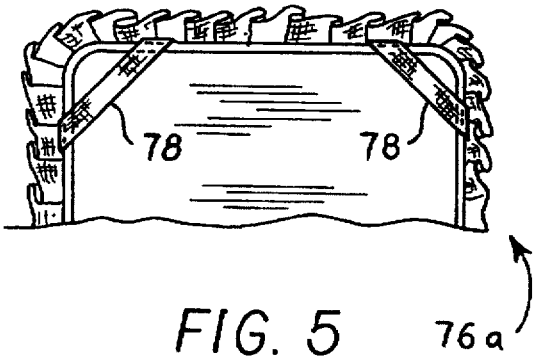
FIG. 5 is a partial bottom plan view similar to the forward portion of the folding chair of FIG. 4, showing an alternative slipcover attachment means for use with folding chairs.
Figure 6:
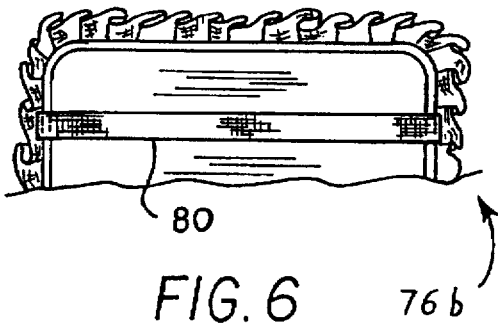
FIG. 6 is a partial bottom plan view similar to the forward portion of the folding chair of FIGS. 4 and 5, showing another alternative attachment means for use with folding chairs.

The present slipcover invention provides a solution for this problem, by an anchor means disposed beneath the seat cover portion of the slipcover and opposite the rear edge thereof, as shown in FIGS. 4 through 6. (The seat cover portion of the slipcover is not shown in these figures, due to the bottom view of the chair seat being positioned thereover, but is similar to the seat covers disclosed in other views and embodiments.) In FIG. 4, a transverse anchor panel 72 is provided beneath the forward edge of the seat cover portion, forming a pocket 74 therebetween into which the forward portion of the chair seat is placed when the slipcover 76 is installed over the chair. This pocket 74 precludes the seat cover portion of the slipcover 76, from slipping upwardly, rearwardly, or laterally relative to the seat of the chair. Other straps or ties, not shown but similar to those shown in FIG. 3, may be provided at the rear of the seat cover portion for additional security.

FIGS. 5 and 6 provide additional variations on the above slipcover retaining means. In FIG. 5, a pair of diagonally disposed retaining straps 78 are provided beneath the seat cover portion of a slipcover 76*a*, and pass beneath the opposite front corners of the seat portion of the chair to capture the seat corners between the straps 78 and seat cover of the slipcover 76*a*. FIG. 6 discloses a single lateral strap 80 extending across the slipcover 78*b*, beneath the seat cover portion thereof and serving to capture the seat portion of the chair between the strap 80 and the overlying seat cover portion of the slipcover 78*b*. Any of the above described anchor means will be seen to provide for the anchoring of various embodiments of the present slipcover to an underlying chair, and other anchor means may be provided as desired.

In summary, the present slipcovers in their various embodiments will be seen to provide a much more pleasant appearance for temporary seating. The temporarily attachable and removable trim accessories provide for the "customizing" of such slipcovers, to suit the decor, mood, or occasion of the event at which the slipcovers are being used. The reversibility of the slipcovers, in at least one embodiment, provides even greater versatility, while the anchor means provides security for the slipcovers.

It is to be understood that the present invention is not limited to the sole embodiments described above, but encompasses any and all embodiments within the scope of the following claims.

I claim:

1. In combination, a removable slipcover and a chair structure having a plurality of legs, a seat, and a chair back, said removable slipcover comprising:

a seat cover portion having a rear edge with a first end and an opposite second end, and a skirt attachment edge extending about said seat cover portion from said first end to said second end of said rear edge;

a chair back cover portion, comprising a front and an opposite rear panel of material defining a seat back pocket therebetween, with said front panel and said rear panel each having a lower edge;

said lower edge of said front panel of said chair back cover portion being secured to said rear edge of said seat cover portion, and said rear panel having a lowermost portion extending below said lower edge of said front panel to form a rear skin portion extending downwardly substantially the length of the chair legs;

a skirt portion depending from said skirt attachment edge of said seat cover portion, and extending completely therearound and attaching to said rear skin portion in an unbroken length;

said slipcover being reversible, with said seat cover portion, each said panel of said chair back portion, and said skirt portion each being formed of a first and an opposing different second sheet of material respectively providing different first and second display surfaces, with one of said different display surfaces being exposed when said slipcover is removably placed over said chair structure, and;

at least one removably attachable trim accessory applied to said rear panel of said chair back cover portion, with said trim accessory and said rear panel each having mating fastener means thereon, providing for the removable attachment of said at least one removable trim accessory to said rear panel.

2. The combination according to claim 1, including:

a plurality of removably attachable trim accessories, with each of said trim accessories having a different configuration from one another.

3. The combination according to claim 1, said removable slipcover further including:

a removably attachable trim accessory applied to said skirt portion, with said skirt portion and said trim accessory each having mating fastener means thereon, providing for the removable attachment of said trim accessory to said skirt portion.

4. The combination according to claim 1, said removable slipcover including:

anchor means providing for the removable securing of said slipcover to the seating.

5. The combination according to claim 4, said anchor means being disposed beneath said seat cover portion and opposite said rear edge thereof, and providing for the anchoring of said seat cover to the seat of said chair structure when said slipcover is removably installed thereover.

6. The combination according to claim 4, said anchor means includes a plurality of elongate straps disposed beneath said seat cover portion adjacent said rear edge, said straps providing for the anchoring of said seat cover to the legs of said chair structure when said slipcover is removably installed thereover.

7. The combination according to claim 1, said removable slipcover including:

padding disposed at least beneath a portion of said seat cover portion of said slipcover.

8. The combination according to claim 7, said removable slipcover including:

padding disposed beneath at least a portion of said front panel of said chair back cover portion of said slipcover.

9. A removable, reversible slipcover adapted for use with a chair structure having a plurality of legs, a seat, and a chair back, said slipcover comprising:

a seat cover portion having a rear edge with a first end and an opposite second end, and a skirt attachment edge extending about said seat cover portion from said first end to said second end of said rear edge;

a chair back cover portion comprising a front and opposite rear panel of material defining a seat back pocket therebetween, with said front panel and said rear panel each having a lower edge;

said lower edge of said front panel of said chair back cover portion being secured to said rear edge of said seat cover portion, and said rear panel having a lowermost portion extending below said lower edge of said front panel to form a rear skirt portion extending downwardly substantially the length of the chair legs;

a skirt portion depending from said skirt attachment edge of said seat cover portion, and extending completely therearound and attaching to said rear skirt portion in an unbroken length;

said seat cover portion, each said panel of said chair back portion, and said skirt portion are each formed of a first and an opposing different second sheet of material respectively providing different first and second display surfaces, with said reversible slipcover being adapted for placement over the chair structure with one of said different display surfaces being selectively alternatively exposed when said reversible slipcover is removably placed over the chair structure, and;

at least one removably attachable trim accessory, with said trim accessory and said slipcover each having mating fastener means thereon, providing for the removable attachment of said at least one removable trim accessory to said slipcover.

10. The removable slipcover according to claim 9, including:

a plurality of removably attachable trim accessories, with each of said trim accessories having a different configuration from one another.

11. The removable slipcover according to claim 9, wherein:

said removably attachable trim accessory comprises a component adapted to be removably secured to said rear panel of said chair back cover portion, with said rear panel of said chair back cover portion including fastener means for said trim accessory.

12. The removable slipcover according to claim 9, wherein:

said removably attachable trim accessory comprises a skirt attachment adapted to be removably secured at least to said skirt attachment edge of said seat cover portion, with said exposed periphery including fastener means for said skirt attachment.

13. The removable slipcover according to claim 9, including:

anchor means providing for the removable securing of said slipcover to the seating as desired.

14. The removable slipcover according to claim 13, wherein:

said anchor means is disposed beneath said seat cover portion and opposite said rear edge thereof, and provides for the anchoring of said seat cover to the underlying seat of the seating when said slipcover is removably installed thereover.

15. The removable slipcover according to claim 13, wherein:

said anchor means comprises a plurality of elongate straps disposed beneath said seat cover portion opposite said exposed periphery, with said straps providing for the anchoring of said seat cover to the legs of the seating when said slipcover is removably installed thereover.

16. The removable slipcover according to claim 9, including:

padding disposed at least beneath a portion of said seat cover portion of said slipcover.

17. The removable slipcover according to claim 16, including:

padding disposed beneath at least a portion of said front panel of said chair back cover portion of said slipcover.

* * * * *